US008088003B1

(12) United States Patent
Bickerton et al.

(10) Patent No.: US 8,088,003 B1
(45) Date of Patent: Jan. 3, 2012

(54) AUDIO/VISUAL DISPLAY TOY FOR USE WITH RHYTHMIC RESPONSES

(75) Inventors: Matthew James Bickerton, Redhill (GB); Michael Lee Simpson, Redhill (GB); Daniel Judkins, Boston, MA (US)

(73) Assignees: Hasbro, Inc., Pawtucket, RI (US); JKID, Ltd., Pawtucket, RI (US)

( * ) Notice: Subject to any disclaimer, the term of this patent is extended or adjusted under 35 U.S.C. 154(b) by 1099 days.

(21) Appl. No.: 11/861,011

(22) Filed: Sep. 25, 2007

(51) Int. Cl.
*A63F 9/24* (2006.01)

(52) U.S. Cl. ..... 463/30; 463/31; 463/35

(58) Field of Classification Search ..... 463/7, 9, 463/30, 31, 35
See application file for complete search history.

(56) References Cited

U.S. PATENT DOCUMENTS

| | | | |
|---|---|---|---|
| 4,207,087 | A | 6/1980 | Morrison et al. |
| 4,261,563 | A | 4/1981 | Goldfarb |
| 4,285,517 | A | 8/1981 | Morrison |
| 4,322,073 | A | 3/1982 | Slavik et al. |
| 4,339,135 | A | 7/1982 | Breslow et al. |
| 5,743,796 | A | 4/1998 | Orak et al. |
| 2006/0166745 | A1 | 7/2006 | Lo |

*Primary Examiner* — Corbett B Coburn
(74) *Attorney, Agent, or Firm* — Perry Hoffman

(57) ABSTRACT

A game having a base structure including an array of lights with associated music. A player must respond to the illumination and music issued by the game by pressing a series of sensors located on the game at specific beats according to the rhythm and illumination of the game. A sequential linear illumination of the light displays can progress from the center outward to the sensor or progress from the sensor inward to the center.

18 Claims, 3 Drawing Sheets

AUDIO/VISUAL DISPLAY TOY FOR USE WITH RHYTHMIC RESPONSES

BACKGROUND OF THE INVENTION

1. Field of the Invention

The present invention relates to electromechanical toys. More particularly, the invention relates to a game electromechanical game where a player must input commands in response to musical and visual cues.

2. Description of the Related Art

The toy industry is constantly attempting to provide users with more intricate and entertaining toys featuring new technology, while presenting the technology in user friendly and intuitive design. Traditionally, this consists of adapting new technology to classic games that are familiar to the users.

One such type of game, Simon Says, has been adapted in numerous electronic toys. U.S. Pat. No. 4,207,087 to Morrison discloses a game device with four colored-coated keys, each emitting a specific tone when depressed and representing a single color, which issues a series of commands for the player to follow. U.S. Pat. No. 4,285,517 to Morrison discloses a game device having visual output wherein players are required to estimate time intervals, a number of events, a tone frequency, or the like. U.S. Pat. No. 4,261,563 to Goldfarb discloses a similar device having linear arrays of lights thereon for use in score keeping.

While the aforementioned game did adapt new technology to a classic game, technology continues to improve and, therefore, these uses have become outdated. To adapt to the every changing and evolving world, new technology must be introduce that with capture the attention of the users.

SUMMARY OF THE INVENTION

The present invention solves the aforementioned needs by creating an electromechanical game where a player must input commands in response to musical and visual cues.

Briefly summarized, the present embodiment includes a game comprising a base structure having an array of LEDs and sensor such as mechanical or inputs thereon. The game includes LEDs of four different colors which are arranged in rows so that all the LEDs in each row are of the same color. The LEDs are arranged in four rows which extend outwardly from a center point and sensors are provided at the outer ends of the TOWS.

During the course of game play the LEDs are illuminated starting with the inner most LED in a particular row and then progressing outwardly to the outermost LED in the same row. The LEDs are illuminated based on beat detection derived from a music program played by an audio system of the game. Correct or incorrect presses of the sensors are further coordinated with sound effects.

During the course of game play a user is required to contact the sensor at the outer end of a row while the LED at the outer end of the same row is illuminated. Accordingly, the user can observe the progression of LEDs as the illumination advances outwardly in the respective row to anticipate the appropriate time for the user to contact the adjacent sensor. During the course of game play the degree of difficulty is increased by occasionally requiring a user to contact the sensors twice each time an outermost LED is illuminated or by changing the beat of the music which forms the basis of the LED program.

DETAILED DESCRIPTION OF THE EMBODIMENTS

Figure 1:
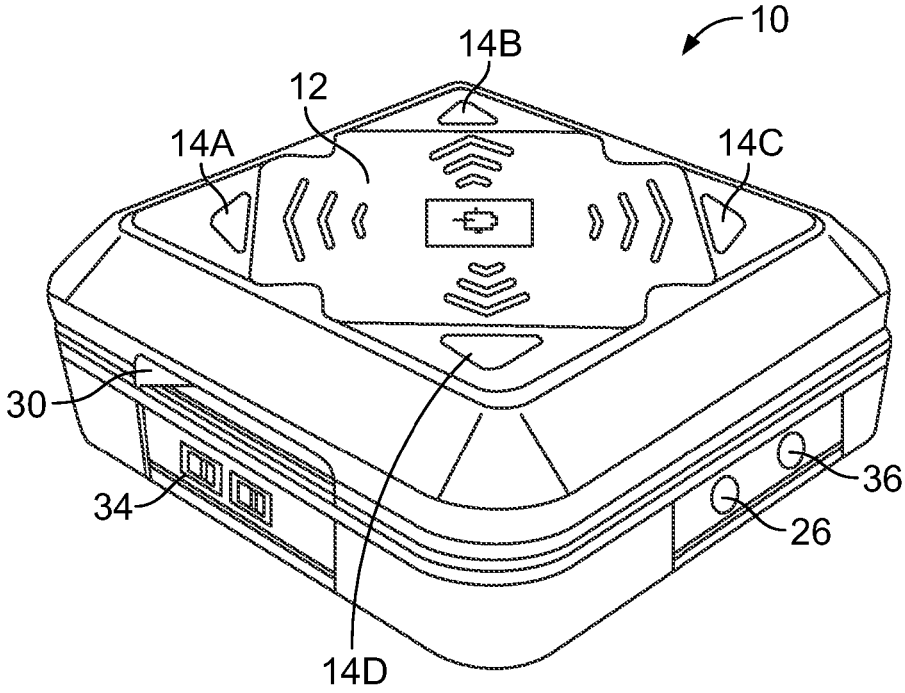
FIG. 1 is a perspective view of the game in closed mode.
Figure 2:
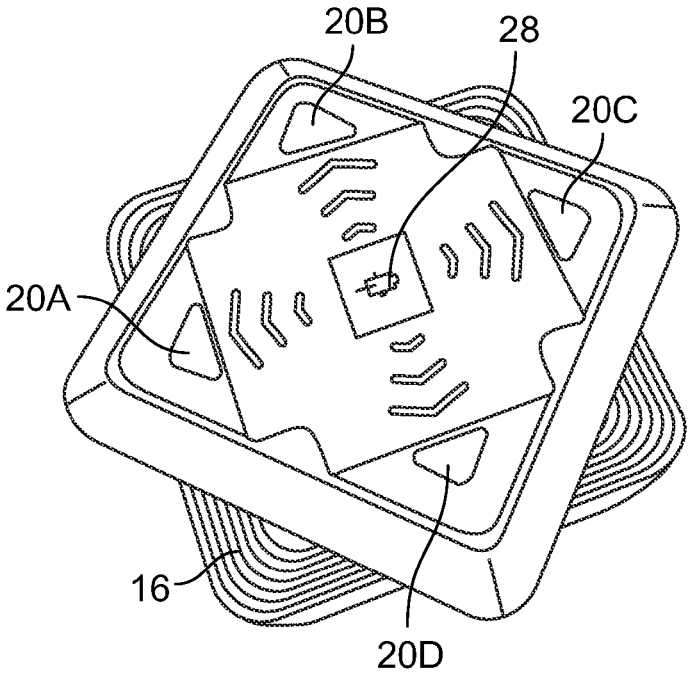
FIG. 2 is a plan overhead view of the game in open mode.

The described embodiment includes a game 10, as seen in FIG. 1 comprising a base structure or playing surface 12 having an array of individual light elements 18, LED's (light emitting display) in the present embodiment, and sensors 14A, 14B, 14C, and 14D, four tactile, or tact, switches in the present embodiment, although the sensors may included capacitive sensors or mechanical inputs such as, but not limited to keys, switches, and buttons. FIG. 2 shows the game 10 rotated along the vertical axis in the open position. In the open position, the concave element 30 is aligned with the audio system 16 to produce an amplification or horn effect.

Figure 3:
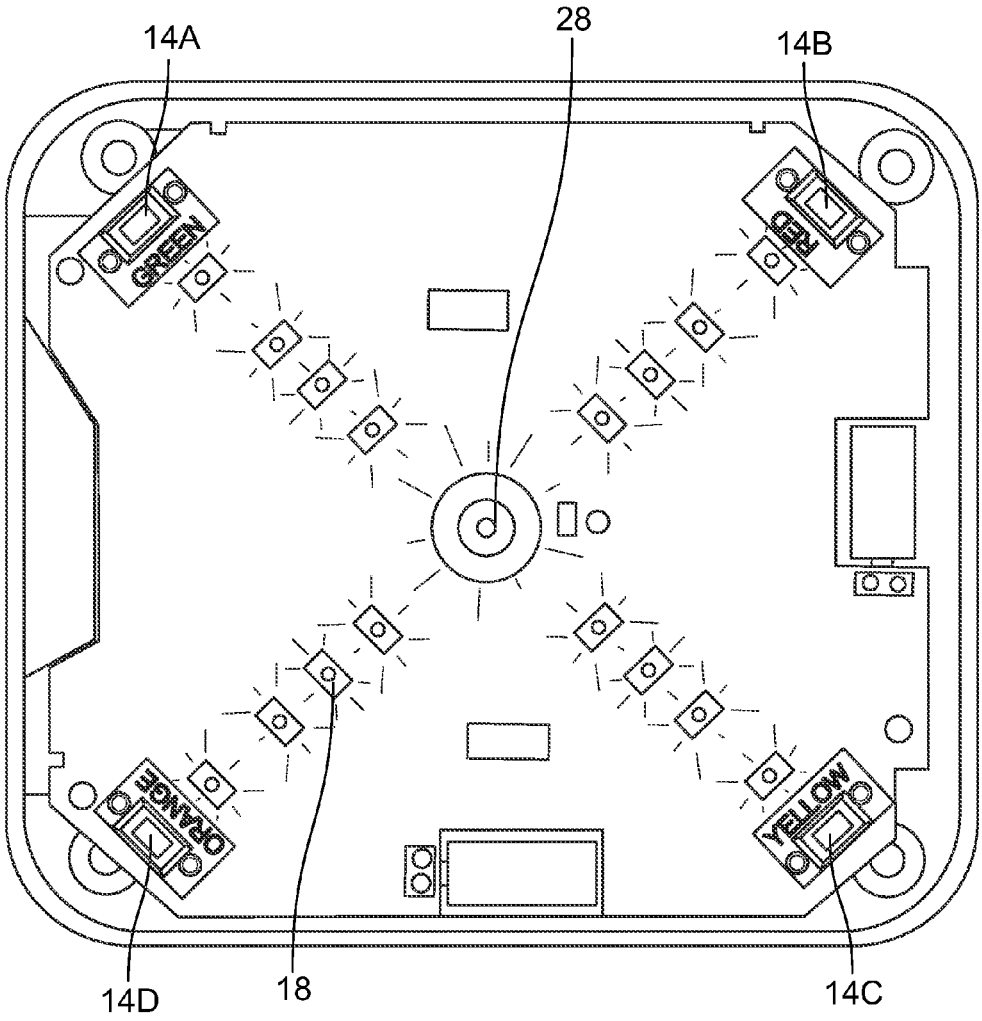
FIG. 3 is a plan overhead view of the individual light elements and light displays.

The game 10, of the present embodiment includes individual light elements 18 of four different colors which are arranged in light displays 20A, 20B, 20C, and 20D as individual rows so that all the individual element elements 18 in each row are of the same color as seen in FIG. 3. The light displays 20A, 20B, 20C, and 20D are arranged in four rows which extend outwardly from a center point, the location of an on/off button 28, and sensors 14A, 14B, 14C, and 14D are provided at the outer ends of the rows.

During the course of game play the light displays 20A, 20B, 20C, and 20D are illuminated starting with the inner most individual light element 18 in a particular row and then progressing outwardly to the outermost individual light element 18 in the same row. The light displays 20A, 20B, 20C, and 20D are illuminated based on beat detection derived from a music program played during the game 10.

While playing the game 10, a user is required to contact the sensor 14A, 14B, 14C, and 14D at the outer end of a row while the individual light element 18 at the outer end of the same row is illuminated. Accordingly, the user can observe the progression of individual light elements 18 in the light display 20A, 20B, 20C, or 20D as the illumination advances outwardly in the respective row to anticipate the appropriate time for the user to contact the adjacent sensor 14A, 14B, 14C, and 14D.

The degree of difficulty is increased during game play by occasionally requiring a user to contact the sensors 14A, 14B, 14C, and 14D twice each time an outermost individual light element 18 is illuminated or by changing the beat of the music which forms the basis of the game 10.

The game 10 includes an information processor housed within its base 12. The information processor may or may not coordinate the illumination of the individual light elements 18 within the lights displays 20A, 20B, 20C, and 20D with sound effects from the sound files, shown in Table 1, and music and light samples from the music library, shown in Table 2.

TABLE 1

Speech List

| # | File Name | Speech length (sec) |
|---|---|---|
| | Play List Sound FX | |
| 0 | 1 kHz | 0.000 |
| 1 | gamel.wav (playlist) | 141.904 |

TABLE 1-continued

| Speech List | | |
|---|---|---|
| # | File Name | Speech length (sec) |
| 2 | Try me.wav (playlist) | 12.687 |
| 3 | Sarcastic Slow Clap.wav (play list) | 2.129 |
| 4 | Single Clap_a.wav (play list) | 1.655 |
| 5 | Medium Clap.wav (play list) | 3.296 |
| 6 | fast clap_a.wav (play list) | 3.146 |
| 7 | startupl.wav | 1.415 |
| 8 | Boo.wav | 2.362 |
| 9 | large_applause.wav | 3.842 |
| 10 | singleclap1.wav | 0.098 |
| 11 | singleclap2.wav | 0.111 |
| 12 | singleclap3.wav | 0.077 |
| 13 | med_clap1.wav | 0.461 |
| 14 | med_clap2.wav | 0.234 |
| 15 | med_clap3.wav | 1.070 |
| 16 | fastclap1a.wav | 0.306 |
| 17 | fastclap2ax3.wav | 2.550 |
| 18 | fastclap3a.wav | 0.290 |
| 19-31 | Loop1a.wav-Loop5b.wav | 1.995-8.001 |
| 32 | tryme2.wav | 2.691 |

The speech system includes an information processor such as a microprocessor or controller to perform the speech function. The microprocessor would use a masked ROM, which includes the speech clips as listed above in Table 1 at a sampling rate of 16 K Hz.

TABLE 2

| Music Sound List | | | |
|---|---|---|---|
| No. | Wave File | seconds | Usage |
| 1 | 1 KHz Test Tone | | |
| 2 | Whole music as pre playlist beside | | |
| 3 | Try me play list | | |
| 4 | Sarcastic Slow Clap play list | | |
| 5 | Single Clap play list | | |
| 6 | Medium Clap play list | | |
| 7 | Fast Clap play list | | |
| 8 | startup1 | 1.415 | Start Up |
| 9 | confirm1 | 0.165 | Confirm |
| 10 | Boo | 2.362 | Score 1a |
| 11 | large_applause | 3.842 | Score 4b |
| 12 | singleclap1 | 0.098 | Score 1a, 1b & 2a |
| 13 | singleclap2 | 0.111 | Score 1a, 1b & 2a |
| 14 | singleclap3 | 0.077 | Score 1a, 1b & 2a |
| 15 | med_clap1 | 0.461 | Score 2b & 3a |
| 16 | med_clap2 | 0.234 | Score 2b & 3a |
| 17 | med_clap3 | 1.070 | Score 2b & 3a |
| 18 | fastclap1 | 0.306 | Score 3b & 4a |
| 19 | fastclap2 | 0.850 | Score 3b & 4a |
| 20 | fastclap3 | 0.290 | Score 3b & 4a |
| 21-33 | Loop1a-Loop5b | 1.995-8.001 | Game 1 |
| 34 | tryme2 | 2.691 | tryme |

The light processes as shown above in Table 2 are also performed by way of the information processor to occur at various durations and start times.

The sound effects and music are both issued from an audio system 16, which is also responsive to the information processor. The audio system 16 can also be heard through the use of head phones connected through the head phone input 36.

The game 10 also features an external data input 26 to stream, import or otherwise process external data files to be played through the audio system 16 in conjunction with the light displays 20A, 20B, 20C, and 20D and sound effects.

A method for playing the game includes several game modes. To start the game 10, the player turns on the game with the center push on/off button 28. The player must make sure the game 10 is not in "Try Me" mode by adjusting the difficulty switch 34. The game 10 features three difficulty levels and the "Try Me" mode. In the present embodiment, the center button 28 will flash blue, if pressed again the on/off button 28 will start a game mode. In the present embodiment, there are two modes, game mode and light show mode. The light show mode will start in about 10 seconds after engaging an external data input 26.

Upon the selection of Game mode that location will flash confirmation with its unique light display 20A, 20B, 20C, or 20D color and sound tone. The user may then select from the game modes.

In Dance Beat, the main game mode, the player must follow the light prompts 20A, 20B, 20C, and 20D to press the right input 14A, 14B, 14C, or 14D at the correct time to coincide with the beat. Players can compete with one selection of onboard music, a music library in the present embodiment, or supply their own with any audio source plugged into the unit at the external data input 26. Upon the selection of Dance Beat the light prompt 20A, 20B, 20C, or 20D will flash confirmation. The Game starts out slowly and grows increasingly harder as the music progresses, with four levels of difficulty within each game level. The music and light prompts 20A, 20B, 20C, and 20D and sound effects will continue at the same speed and timing regardless of the players performance. At the end of the song the player will receive a readout of their score determined by how far into the song they were able to progress and how efficiently. The player's score will be displayed by a series of flashing lights 20A, 20B, 20C, or 20D and sound effects.

In a described embodiment, a player can select Dance mode. Upon the selection of Dance mode, the game 10 will give audio speech confirmation through the audio system 16 and the light display 20A, 20B, 20C, or 20D will flash confirmation. The user may select the dance and difficulty level they wish by pressing one of the four sensors 14A, 14B, 14C, or 14D again. Dance mode features 4 unique programmed dances of varying difficulties.

Dance mode is more or an activity than a game. The player may choose 1 of 4 unique song and dance combinations that are always the same. As they are always the same the player may play them repeatedly and practice them until they can get them perfect each time. At the end of each routine the player's performance score will be displayed by a series of flashing lights with one color representing the 1's 10's and 100's. If the player scores a complete 100 percent the player will receive a celebratory visual display through the light displays 20A, 20B, 20C, and 20D flashing, and a celebratory audio display through the audio system 16.

Upon entry of the Light show mode, the game 10 may or may not give audio speech confirmation through the audio system 16 along with the light display 20A, 20B, 20C, or 20D confirmation found in the present embodiment when the user has their own music plugged into the device in the present embodiment.

Figure 4:
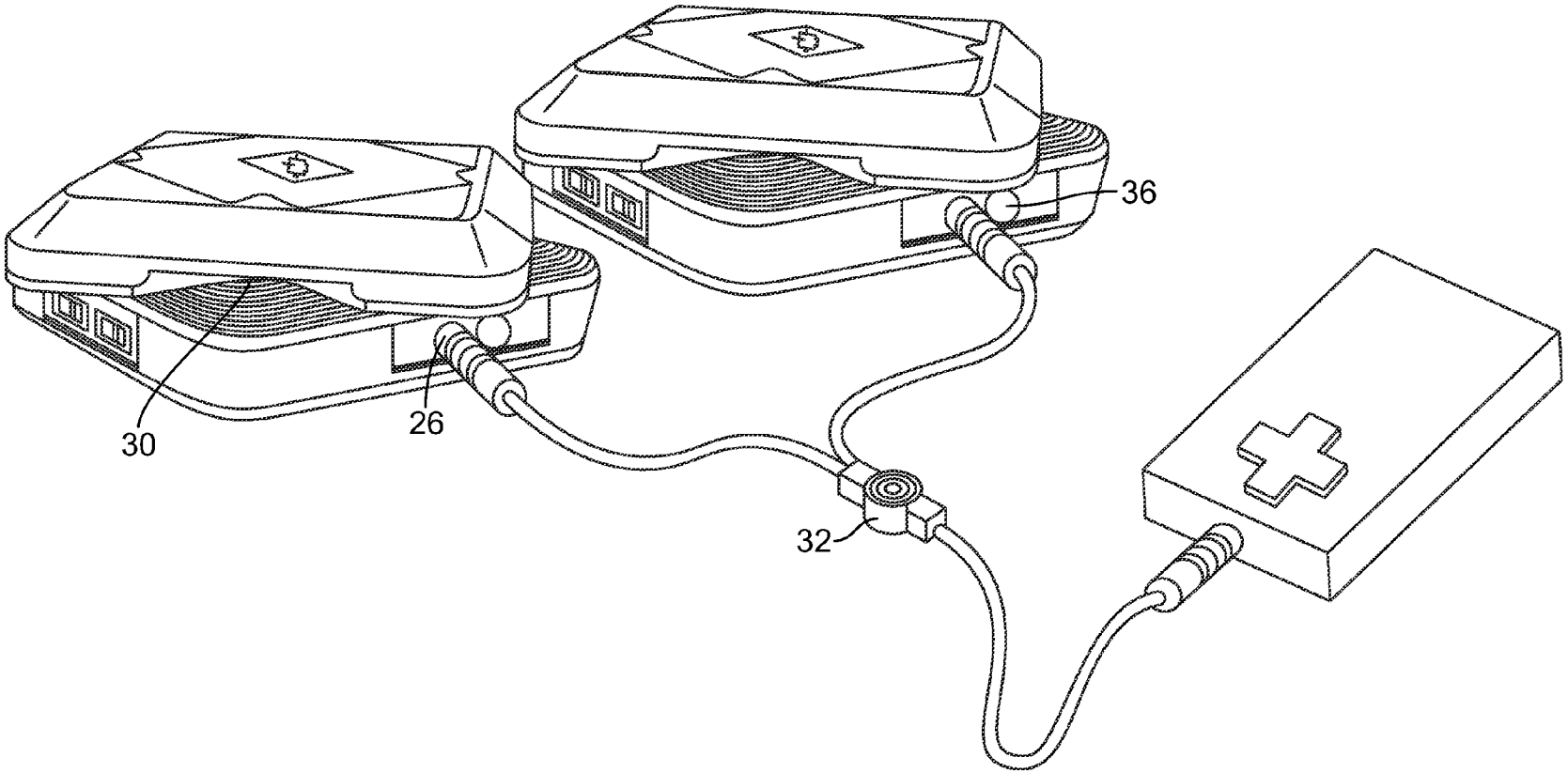
FIG. 4 is a perspective view of two game units connected to a single external music device.

In the present embodiment, the user can also plug an external music supply into multiple games 10 through the use of a "Y" cable 32 as seen in FIG. 4. During Light show mode the game 10 becomes a decorative "watch me" toy where light patterns through the light displays 20A, 20B, 20C, and 20D will be displayed to coincide with the music. The user will also be prompted to press the flashing button 14A, 14B, 14C, or 14D to indicate the length of time they wish to utilize the game in Light Show mode. The "Y" cable 32 is also used in the Game mode so two players can play at the same time.

In an alternative embodiment, a light pattern is displayed with a music riff to signify the activation of the device. The game surface 12 features four sensor selection points 14A, 14B, 14C, and 14D that are located at the clock locations 12, 3, 6 and 9. Each location allows the user to select one of four play modes: Game, Dance, Light Show, and Freestyle.

While in Game mode, of an alternative embodiment, the user may select a Music type by pressing one of the four buttons 14A, 14B, 14C, or 14D again; 14A is Rock, 14B is Pop, 14C is Hip hop and 14D is used for external music plugged into the device. After selection, the game will continue until the user has performed too poorly, then the song and game 10 will end. The player's score will be displayed by a series of flashing lights 20A, 20B, 20C, or 20D and sound effects with one color representing the 1's, 10's, and 100's. Therefore, to display the score 123, the 100 light 20C will flash once followed by the 10 light 20B, twice and finally the 1 20A light three times.

In an alternative embodiment, the Game mode of game 10 will feature Repeater. In Repeater, the game 10 will prompt the user with a series of musical prompts and light displays 20A, 20B, 20C, and 20D that the user will need to repeat to advance. Unlike Dance Beat where the play will continue independent of the users input, Repeater will play a pattern of lights and tones requiring the user to repeat them correctly before advancing. The Repeater game will feature multiple prompts 20A, 20B, 20C, and 20D and the patterns will be much more musical and create a melody. Play will continue until the player fails to correctly repeat a pattern and will receive a readout of their score determined by how far into the song they were able to progress. The player's score will be displayed by a series of flashing lights 20A, 20B, 20C, or 20D with one color representing the 1's 10's and 100's. In the present embodiment, to display the score 123 the 100 light 20C will flash once followed by the 10 light 20B, twice and finally the 1 20A light three times. The game 10 may generate a Repeater game with a finite number of moves so that the player has an opportunity to complete the whole song and be rewarded with it being replayed back to them with flashing lights.

Also in an alternative embodiment, the Game mode of game 10 will feature Quick React. The Quick React game challenges the user's responsiveness to be as quick and accurate as they can. This style of play will be more like the challenging mind puzzles where the user will be directed to input a set number of prompts 20A, 20B, 20C, and 20D and will get a readout between 1 and 100 depending on their performance. Upon selection of Quick React, the game 10 will play a brief confirmation/introduction melody followed by a 3-second pause before the start of game play. During this pause the players must ready themselves for the start of inputs at sensors 14A, 14B, 14C, or 14D which will begin suddenly and not stop until the challenge is over. The game rapidly displays a series of 20-25 light displays 20A, 20B, 20C, and 20D and sound prompts that that the user must duplicate as quickly and accurately as possible. Upon completion, the player's score will be displayed by a series of flashing lights 20A, 20B, 20C, or 20D with one color representing the 1's 10's and 100's. If the player scores a complete 100 percent then the player will receive a celebratory visual display through light displays 20A, 20B, 20C, and 20D and celebratory music through audio system 16.

Alternative embodiments allow the user to select a Music type by pressing one of the four buttons 14A, 14B, 14C, or 14D again. 14A is Rock, 14B is Pop, 14C is Hip hop and 14D is used for external music during the Light Show mode.

In an alternative embodiment, the user can also select one of three preprogrammed music samples from the music library or allow the game to interpret any music source plugged into the device at the external data input 26. The three preprogrammed songs will stop upon completion although the game 10 will remain in Light Show mode for another minute before timing out to the main menu again. During this minute the user may press any button 14A, 14B, 14C, or 14D to trigger another light show display. When the audio input option through external data input 26 is selected then the user will also be prompted to press the flashing button 14A, 14B, 14C, or 14D to indicate the length of time they wish to utilize the game in Light Show mode, understanding that it will affect battery life. Pressing it once will indicate 5 minutes, twice 10 and three times 15 minutes. Each time the button is pressed an individual light element 18 located at the sensor 14A, 14B, 14C, or 14D will illuminate as confirmation. Pressing the sensor 14A, 14B, 14C, or 14D a fourth time will loop back to only the 5-minute indicator being illuminated.

Another alternative embodiment of the game 10 features Freestyle mode. Upon the selection of Freestyle mode, the game 10 will give audio speech confirmation through the audio system 16 and the light display 20A, 20B, 20C, or 20D will flash confirmation and then the user may select a Music type by pressing one of the four buttons 14A, 14B, 14C, or 14D again. 14A is Rock, 14B is Pop, 14C is Hip hop and 14D is when the user has their own music plugged into the device at the external data input 26. During Freestyle mode the player may press whatever buttons 14A, 14B, 14C, or 14D they wish in any order to trigger lights and sounds that correspond to the music. This is a free play activity where the user may press any button 14A, 14B, 14C, or 14D with no consequence and are just able to react to the music by finger dancing and triggering light displays 20A, 20B, 20C, and 20D and their corresponding sound effects through audio system 16 over top of the other music. The lights 18 will be unique in that where normally during game play the light patterns will travel towards the player's sensors 14A, 14B, 14C, or 14D, the pattern travels away on light displays 20A, 20B, 20C, or 20D after being triggered by the user to give a more demonstrative light show during play.

Although players may always play the other game modes individually and compete against one another with the comparison of their final score display, in an alternative embodiment the game 10 features Head to Head. Head to Head is the only game where up to 4 players can directly compete against one another. The play is similar to Dance Beat but must utilize the music provided in game 10 so that the game 10 may easily be passed around. Once this Head to Head is selected the user is prompted to enter the number of players. One sensor 14A, 14B, 14C, or 14D will flash prompting the input of players. Pressing this button 14A, 14B, 14C, or 14D repeatedly will determine how many players from 2 to 4 are playing with the corresponding light display 20A, 20B, 20C, or 20D illuminating to match with the quantity of players. The game 10 will then begin with player one needing to follow the game prompts 20A, 20B, 20C, and 20D correctly until they are prompted to switch to another player. Each player round features the same number of commands, through audio system 16 and visual displays 20A, 20B, 20C, and 20D and the player's performance will be compared against the others forcing elimination. Elimination is determined by the combination of the 2 most recent rounds allowing a player to potentially be saved from a poor or average performance by an exceptional one. Prompts 20A, 20B, 20C, and 20D will indicate which player the device should be passed to and which player is eliminated. During later stages if more than 2 players are still competing, the game 10 may randomize the selection of participants causing them to compete in a surprise order. The game 10 will display a series of light patterns, comprising 20A, 20B, 20C, and 20D, and celebratory music through audio system 16 when all players are eliminated and a winner is declared.

It should be appreciated that a wide range of changes and modifications may be made to the embodiments of the inventions as described herein. It is intended that the foregoing detailed description be regarded as illustrative rather than limiting. While there have been illustrated and described particular embodiments of the inventions, it will be appreciated that numerous changes and modifications will occur to those skilled in the art, and it is intended in the appended claims to cover those changes and modifications which fall within the true spirit and scope of the present invention.

What is claimed is:

1. A device for use in a game, comprising:

a playing surface;

a plurality of sensors comprising at least a first sensor and a second sensor on the playing surface used to input commands;

an audio system used to output music and sound effects;

a plurality of light displays comprising at least a first light display and a second light display, said first light display comprising a series of individual light elements, illuminated in a sequential linear array between the center of the playing surface and the corresponding first sensor, and said second light display comprising a series of individual light elements, illuminated in a sequential linear array between the center of the playing surface and the corresponding second sensor;

a music library with a least one data file; and an information processor that coordinates the light displays to be driven by the music program of the audio system and is responsive to one or more of the plurality of sensors.

2. A device for use in a game as recited in claim 1, comprising an input used to stream external data files.

3. A device for use in a game as recited in claim 1, wherein the sensors are tactile switches sensors.

4. A device for use in a game as recited in claim 1, wherein each light display represents a single color, unique to the other light displays.

5. A device for use in a game as recited in claim 1, wherein the game is capable of being held in the hands of the user.

6. A device for use in a game as recited in claim 1, comprising the sequential linear illumination of the light displays can progress from the center outward to the sensor or progress from the sensor inward to the center.

7. A device for use in a game as recited in claim 1, wherein the playing surface is able to rotate on the vertical axis into an open position.

8. A device for use in a game as recited in claim 7, comprising a concave element that aligns with the audio system when the playing surface is rotated.

9. A method for playing a game, comprising:

watching a plurality of linear light displays extending outwards from the center of a base illuminate away from the center;

determining the destination of the progressing lights, which corresponds to a sensor;

motivating the sensor corresponding to the progressing light display as indicated by the rhythm of accompanying music; and responding to the actions of the game from the determinative steps.

10. A method for playing a game as recited in claim 9, wherein motivating the sensor occurs by touching a sensor.

11. A method for playing a game as recited in claim 9, wherein the game is capable of being held in the hands of a user while playing.

12. A device for use in a game, comprising:

a playing surface;

a plurality of sensors on the playing surface used to input commands;

an audio system used to output music and sound effects;

a plurality of light displays, each said light display comprising a series of individual light elements, illuminated in a sequential linear array between the center of the playing surface and a single, corresponding sensor;

an input for entry of external data files;

a music library with a least one data file; and an information processor that coordinates the light displays to be driven by the music program of the audio system and is responsive to one or more of the plurality of sensors.

13. A device for use in a game as recited in claim 12, wherein the sensors are tactile switches.

14. A device for use in a game as recited in claim 12, wherein each light display represents a single color, unique to the other light displays.

15. A device for use in a game as recited in claim 12, wherein the game is capable of being held in the hands of the user.

16. A device for use in a game as recited in claim 12, wherein the game is capable of being held in the hands of the user.

17. A device for use in a game as recited in claim 12, wherein the playing surface is able to rotate on the vertical axis into an open position.

18. A device for use in a game as recited in claim 12, comprising the sequential linear illumination of the light displays can progress from the center outward to the sensor or progress from the sensor inward to the center.

* * * * *